United States Patent [19]

Velasco

[11] 4,089,067

[45] May 16, 1978

[54] SHIRT

[76] Inventor: Rebecca L. Velasco, 11249 Bootes, San Diego, Calif. 92126

[21] Appl. No.: 794,956

[22] Filed: May 9, 1977

[51] Int. Cl.[2] ..... A41D 1/00

[52] U.S. Cl. ..... 2/69; 2/115

[58] Field of Search ..... 2/115, 93, 69, 69.5, 2/1

[56] References Cited

U.S. PATENT DOCUMENTS

| | | | |
|---|---|---|---|
| 1,282,581 | 10/1918 | House | 2/69 |
| 2,636,176 | 4/1953 | Ross | 2/93 |
| 3,443,066 | 5/1969 | Weibel | 2/69.5 X |
| 3,523,302 | 8/1970 | Rabedeaux | 2/69.5 |

*Primary Examiner*—Alfred R. Guest
*Attorney, Agent, or Firm*—Charles C. Logan, II

[57] ABSTRACT

A shirt having a tubular body portion whose axis would be substantially vertically oriented when being worn by a person. The tubular body portion has a front section and a back section. It also has a top, middle and bottom area. At least four arm sections extend outwardly from the tubular body portion somewhere between its top and middle area and at least two of these arm sections extend from the front section and at least two of the arm sections extend from the back section. The tubular body portion has a body aperture formed in the lower edge of the bottom area and has only one neck aperture formed in the top edge of the top area.

7 Claims, 2 Drawing Figures

SHIRT

BACKGROUND OF THE INVENTION

This invention relates to an article of wearing apparel and more particularly to a novel shirt to be worn by two people at the same time. Shirts having the normal two arms, a neck aperture, and a body aperture, have been known since time immemorial. What has not been known of before, is a novel shirt that is to be worn by two people having four arms extending from the body of the shirt and only a single neck aperture.

It is an object of the invention to provide a novel shirt that may be worn by children, adults, and elderly people for fun.

It is also an object of the invention to provide a novel shirt that can be worn at the same time by two members of the same sex or by two members of opposite sexes.

It is also an object of the invention to provide a novel shirt that can be used by two persons in order to remove anger or histility that might be temporarily existing between these two persons.

It is an additional object of the invention to provide a novel shirt that may be of value in reducing tension between members of a family that are not communicating with each other.

SUMMARY OF THE INVENTION

The shirt invented by the Applicant has a tubular body portion whose axis would be substantially vertically oriented when being worn by one or more persons. The tubular body portion has a front section and a back section. It also has a top, middle and a bottom area. At least four arm sections extend outwardly from the tubular body portion somewhere between its top and middle area. At least two of the arm sections extend outwardly from the front section and at least two of the arm sections extend outwardly from the back section. The tubular body portion has a body aperture formed in the lower edge of the bottom area and it has only one neck aperture formed in the top edge of the top area.

The shirt may be worn by members of opposite sexes at home, in private, or out in public. It may be used at parties in order to break the tension and to help the people attending the party to relax and have a good time. Clever sayings and expressions may be printed on the front or rear of the shirt. Some such sayings might relate to the fact that the persons now wearing the shirts used to be angry at each other and they are not made anymore. The shirt can be used as a catalyst to get people communicating with each other. An example would be where a husband and wife have argued and tension has been created between the two parties. In this instance, the shirt can be used as a therapeutic device that is kept around the house to be put on to remove animosity.

The shirt can also be worn by members of the same sex whether for the purpose of fooling around, or use in games, or merely getting friends back together again who have been angry with each other.

When wearing the shirt, the two persons in it may either be facing each other or they may be facing away from each other. The possibility also exists that they may both be facing in the same direction, in which case, one instance, one person would be in the front or they could be reversed so that that same person is in the rear.

DESCRIPTION OF THE PREFERRED EMBODIMENT

Figure 1:
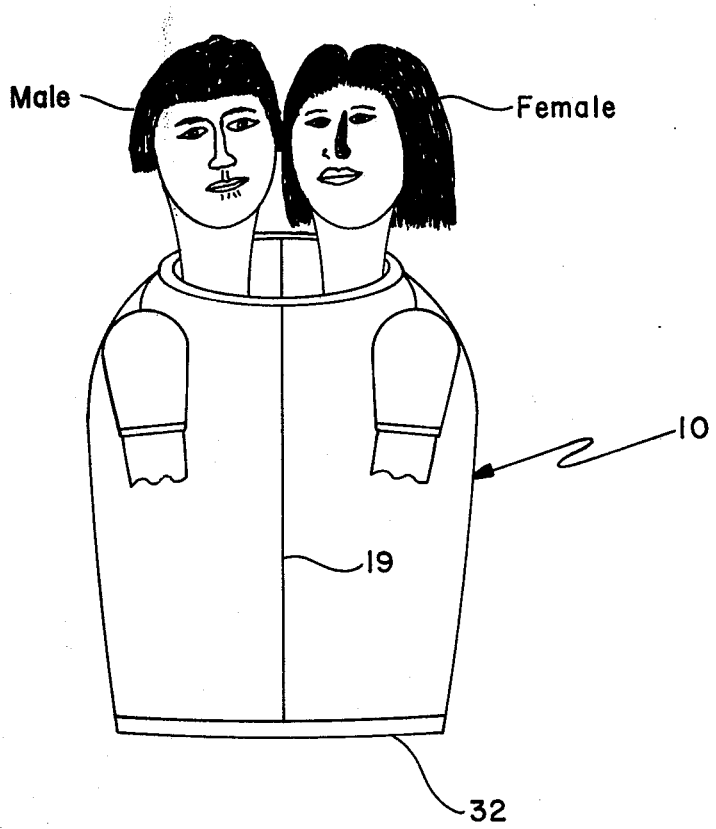
FIG. 1 is a perspective view illustrating the novel shirt with two persons of opposite sexes wearing it.
Figure 2:
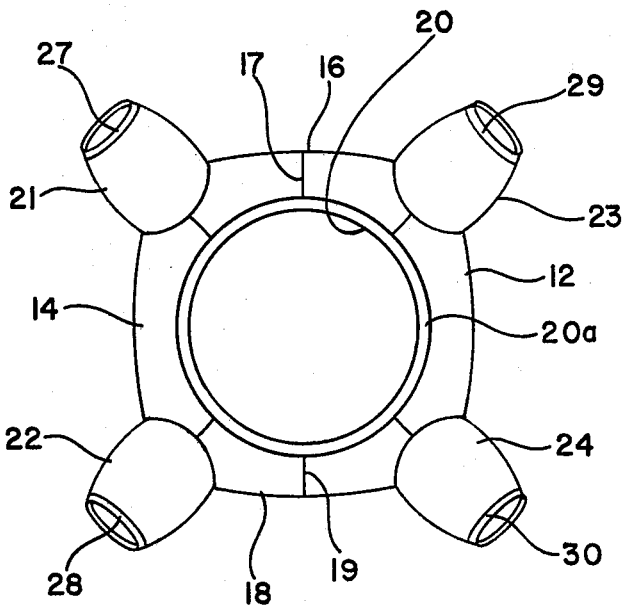
FIG. 2 is a top plan view of the novel shirt.

Applicant's invention will be described by referring to FIGS. 1 and 2, wherein the shirt is generally designated numeral 10. The shirt has a tubular body portion having a front section 12 and a back section 14. The shirt also has side sections 16 and 18. Seams 17 and 19, respectively, separate the front and back sections 12 and 14. Shirt 10 has only one neck aperture 20 formed along the top edge of the tubular body. A neck band **20*a* is formed around the periphery of neck 20**.

The tubular body portion has four arms 21, 22, 23 and 24 extending outwardly from the body portion somewhere between its top and middle area. Arms 21 and 22 extend outwardly from the back section and arms 23 and 24 extend outwardly from the front section. Arm bands 27, 28, 29 and 30 are formed along the outer periphery of the respective arm sections. The bottom of the shirt has a body aperture and around this periphery is formed a waist band 32.

What is claimed is:

1. An article of wearing apparel comprising:

a tubular body portion whose axis would be substantially vertically oriented when being worn by a human;

said tubular body portion having a front section and a back section;

said tubular body portion having a top, middle, and bottom area; and at least four arm sections extending outwardly from said tubular body portion somewhere between its top and middle area, at least two of said arm sections extending from said front section and at least two of said arm sections extending from said back section.

2. An article of wearing apparel as recited in claim 1, wherein said tubular body portion has a body aperture formed in the lower edge of said bottom area.

3. An article of wearing apparel as recited in claim 2, wherein said body aperture has a waist band around its periphery.

4. An article of wearing apparel as recited in claim 2, wherein said tubular body portion has only one neck aperture formed in the top edge of said top area.

5. An article of wearing apparel as recited in claim 4, wherein said neck aperture has a neck band around its periphery.

6. An article of wearing apparel as recited in claim 2, wherein said arm sections have an arm band adjacent their ends.

7. An article of wearing apparel as recited in claim 2, wherein said tubular body portion has a pair of substantially vertical seams between said front and back section.

* * * * *